United States Patent [19]

Kato et al.

[11] 4,297,166

[45] Oct. 27, 1981

[54] THALLIUM-CARRYING TARGET MATERIAL AND ITS PRODUCTION

[75] Inventors: Makoto Kato, Kobe; Nobuo Ueda, Takarazuka; Hiroaki Matsushima, Nishinomiya, all of Japan

[73] Assignee: Nihon Medi-Physics, Co., Ltd., Hyogo, Japan

[21] Appl. No.: 12,809

[22] Filed: Feb. 16, 1979

[30] Foreign Application Priority Data

Feb. 20, 1978 [JP] Japan ..... 53-18678

[51] Int. Cl.[3] ..... C25D 3/02; C25D 3/54; G21G 1/10

[52] U.S. Cl. ..... 376/194; 204/45 R

[58] Field of Search ..... 204/45 R; 176/11, 16

[56] References Cited

U.S. PATENT DOCUMENTS 3,993,538 11/1976 Lebowitz et al. ..... 176/11

FOREIGN PATENT DOCUMENTS 1170658 5/1964 Fed. Rep. of Germany ..... 204/1.5

*Primary Examiner*—Howard S. Williams

*Attorney, Agent, or Firm*—Birch, Stewart, Kolasch & Birch

[57] ABSTRACT

A method for production of a thallium-carrying target material comprising a thermo-conductive support and metallic thallium electro-plated thereon, which comprises applying a DC-AC overlapped electric current between an anode made of a metal or its alloy having a lower ionization tendency than hydrogen and the electro-conductive support as a cathode, both electrodes being immersed in a bath of an electro-plating solution comprising monovalent thallium ions in the presence of at least one of aromatic amines and phenols, so as to deposit the thallium metal on the surface of the thermo-conductive support.

10 Claims, No Drawings

THALLIUM-CARRYING TARGET MATERIAL AND ITS PRODUCTION

The present invention relates to a thallium-carrying target material and its production. More particularly, it relates to a metallic thallium-carrying target material suitable for production of $^{201}Tl$ by accelerated particle irradiation upon the metallic thallium, and a method for production of such target material.

It is well known that monovalent thallium ions, when injected into an animal or a human, are accumulated selectively in some specific organs and tissues such as the myocardium and the tumor tissues. On the other hand, $^{201}Tl$ has a relatively short half life (i.e. about 74 hours) and decays by electron capture without emission of $\beta$-radiation. Due to these biological and physical properties, $^{201}Tl$ is nowadays used widely in the field of diagnostic medicine.

In general, $^{201}Tl$ can be produced through the irradiation of mercury or thallium as a target substance by accelerated particles such as deuteron or proton using a particle accelerator (e.g. a cyclotron). Most of the kinetic energy carried by the accelerated particles, however, is converted into heat on the target substance, and hence the temperature of the target substance is highly elevated during the irradiation, whereby the target substance is melted or evaporated to waste into the atmosphere in the particle accelerator. In order to prevent such waste, the irradiation beam current should be controlled to keep a relatively low level (e.g. 30 $\mu$A or less). The application of such low level irradiation beam current leads some disadvantages from the viewpoint of the efficient production of $^{201}Tl$.

As the result of an extensive study, it has now been found that if and when thallium metal as a target substance is electro-plated on a thermo-conductive support using a certain specific procedure, the produced $^{203}Tl$ metal can remain firmly on the surface of the support, and it enables one to prevent any material waste during the irradiation even at a high irradiation beam current (e.g. 120 $\mu$A or more). Thus, the use of the above target substance enables one to produce $^{201}Tl$ with a high efficiency. This invention is based on the above finding.

According to the present invention, there is provided a thallium-carrying target material suitable for production of $^{201}Tl$ by accelerated particle irradiation, which comprises a thermo-conductive support and a thallium metal layer of high density firmly electro-plated thereon. Such metallic thallium-carrying target material can be prepared by applying a DC-AC overlapping electric current between an anode made of a metal or its alloy having a lower ionization tendency than hydrogen, and an electro-conductive support as a cathode, both electrodes being immersed in a bath of an electro-plating solution comprising monovalent thallium ions in the presence of at least one of aromatic amines and phenols, to deposit the thallium metal on the electro-conductive support.

The support, which carries metallic thallium as a target substance thereon, is required to be thermo-conductive and electro-conductive. Thus, the support is made from a metal of excellent thermo-conductivity and electro-conductivity such as copper or silver, or one of their alloys. These metals should not cause any chemical or radio-chemical contamination into the final, i.e. $^{201}Tl$. From the economical viewpoint, a copper-made support is particularly preferred. The support may be shaped in any form. A plate form, particularly the one which can be easily installed in a particle accelerator (e.g. a cyclotron), is favorable.

As the electro-plating solution, there is employed an aqueous solution containing monovalent thallium ions in the presence of at least one of aromatic amines and phenols. There is no limitation on the selection of the counter-ions for the monovalent thallium ions, and they may be, for instance, halide ions (e.g. chloride ions), sulfate ions or carboxylate ions (e.g. oxalate ions).

The electro-plating solution is usually prepared by dissolving at least one of monovalent thallium salts and at least one of aromatic amines and phenols into water. Examples of the thallium salt are thallium(I) chloride, thallium(I) sulfate, etc. The thallium source may be natural, but the one containing $^{203}Tl$ at a higher concentration ($^{203}Tl$ enriched material) is favorable in view of the production efficiency. Any limitation is not present on the concentration of the monovalent thallium ions in the electro-plating solution, and usually a saturated or almost saturated solution of the monovalent thallium salt may be employed until the thallium ions therein are substantially consumed for electro-plating. The aromatic amine or phenol may be any derivative of aromatic hydrocarbon (e.g. benzene, naphthalene) bearing at least one amino or hydroxy group directly attached to the aromatic ring, and their examples are phenol, cresol, aniline, toluidine, etc. The concentration of the aromatic amine or phenol may be ordinarily from 0.1 to 3% (w/v), preferably from 0.5 to 1% (w/v). The electro-plating solution is normally acidic and, if necessary, may be adjusted to an acidity of from 0.05 to 0.5 N, preferably around 0.2 N, by adding an acidic reagent (e.g. hydrochloric acid, sulfuric acid) thereto.

The electro-plating is effected by applying a DC-AC overlapping electric current between an anode and the support as a cathode, both electrodes being immersed in the electro-plating solution. The anode is made of a metal or its alloy having a lower ionization tendency than hydrogen or its alloy. Examples of such metal are platinum, copper, silver, etc. The DC-AC overlapping electric current to be used is an overlapped electric current consisting of a DC voltage of 0.5 to 5 V (preferably around 2.8 V) and an AC voltage of 0.1 to 2 V (mean voltage) (preferably around 0.56 V). The frequency of AC may be from 50 to 60 Hz. The electric current value is varied with the distance between the electrodes, the voltage to be applied, etc. and may be usually from 5 to 150 mA, preferably from 55 to 60 mA.

The thallium metal layer thus electro-plated has a high density and firmly adheres to the surface of the support. Due to this reason, the thallium metal layer is quite resistant to the irradiation by the accelerated particles such as accelerated protons even at such a high irradiation beam current of 120 $\mu$A and remains on the surface of the support without any elimination. Therefore, $^{201}Tl$ can be produced with a high efficiency using the thallium carrying target of the invention.

When the accelerated particles are irradiated onto the thallium metal layer, the reaction proceeds according to the formula: $^{203}Tl$ (p, 3n) $^{201}Pb$, and the decay of the produced $^{201}Pb$ affords $^{201}Tl$. In case of using the thallium carrying target material of the invention, the irradiation is usually carried out under the following conditions by a conventional procedure: beam current, 80 to 150 $\mu$A; beam energy, 20 to 35 MeV (preferably around 26 MeV). The irradiation time may be from 3 to 20 hours. Separation and recovery of $^{201}Tl$ from the thus irradiated target material through $^{201}Pb$ may be effected by a conventional procedure.

As can be understood from the above descriptions, the most characteristic feature of the present invention resides in the electro-plating of thallium metal through a certain specific procedure. As can be seen in Comparative Example hereinafter presented, the thallium metal layer electro-plated on a support by any other procedure is readily eliminated or evaporated on irradiation even at a low irradiation beam current as 50 A, and therefore $^{201}Tl$ can not be obtained in a high efficiency. This may be caused by the low density or spongy-like structure of the thallium metal layer formed on the support.

Practical and presently preferred embodiments of the invention will be illustratively shown in the following Examples.

EXAMPLE 1

Thallium(I) sulfate (reagent grade) (4.3 g) was dissolved in distilled water (75 ml) while heating and stirring. After cooling to room temperature, conc. sulfuric acid (reagent grade) (1.1 ml) and o-cresol (0.8 ml) were added thereto, followed by stirring to give an electro-plating solution.

The surface of a support plate made of copper was polished with a polishing paper (No. 400), washed with distilled water and acetone (reagent grade) in order and dried. The electro-plating solution was charged into a bath, which was installed with the support plate, and a platinum electrode was inserted therein. The bath was designed so as to contact the electro-plating solution with the desired central region of the support plate. The plus terminal of a DC-AC overlapping power supply was connected to the platinum anode, and the minus terminal was connected to the support plate. Then, the electric current was applied thereto at a DC value of 57 mA for 100 minutes, during which the DC voltage and the AC voltage were respectively adjusted to 2.8 V and 0.55 V. Thus electro-plated plate was taken out from the bath, washed with distilled water and acetone in order and dried. The weight of the electro-plated thallium metal layer on the support plate was 731 mg.

EXAMPLE 2

$^{203}Tl$ enriched thallium metal, i.e. metallic thallium having a $^{203}Tl$ concentration of 87% (w/w), (3.0 g) was cut into small pieces on a filter paper. The thallium metal pieces were placed in a beaker, and distilled water (15 ml) was added thereto. After the addition of conc. nitric acid (reagent grade) (15 ml), the resultant mixture was gradually heated on a water bath kept at 90° to 98° C. while stirring, and then heating was continued under reduced pressure whereby water was evaporated to dryness. Distilled water (25 ml) was added to the residue, and the mixture was heated to make a clear solution. To the solution, conc. sulfuric acid (reagent grade) (1.4 ml) was added, and water was evaporated under reduced pressure to dryness. The addition of distilled water (25 ml) and the evaporation of water under reduced pressure were repeated once more. The residue was dissolved in distilled water (25 ml), sulfur dioxide gas was introduced therein at a rate of 100 ml/min for 3 minutes, and then water was evaporated to dryness. The residual white crystals were dissolved in distilled water (60 ml), and conc. sulfuric acid (reagent grade) (0.1 ml) and o-cresol (0.6 ml) were added thereto to make an electro-plating solution.

The electro-plating was carried out as in Example 1 but using the electro-plating solution prepared above and adopting the following conditions: DC value, 60 mA; DC voltage, 2.7 V; AC voltage, 0.54 V; time, 78 minutes. As the result, there was obtained a target plate bearing metallic thallium (572 mg) electro-plated thereon.

EXAMPLE 3

Thallium(I) sulfate (reagent grade) (4.3 g) was dissolved in distilled water (75 ml) with heating and stirring. After cooling to room temperature, conc. sulfuric acid (reagent grade) (1.1 ml) and o-toluidine (0.8 ml) were added thereto while stirring to make an electro-plating solution.

The electro-plating was carried out as in Example 1 but using the electro-plating solution prepared above and adopting the following conditions: DC value, 57 mA; DC voltage, 2.8 V; AC voltage, 0.55 V; time, 100 minutes. As the result, there was obtained a target plate bearing metallic thallium (625 mg) electro-plated thereon.

EXAMPLE 4

Thallium(I) fluoride (reagent grade) (5.0 g) was dissolved in distilled water (100 ml) with heating and stirring. After cooling to room temperature, conc. sulfuric acid (reagent grade) (1.1 ml) and o-cresol (0.8 ml) were added thereto to make an electro-plating solution.

The electro-plating was carried out as in Example 1 but using the electro-plating solution prepared above and adopting the following conditions: DC value, 60 mA; DC voltage, 2.7 V; AC voltage, 0.54 V; time, 80 minutes. As the result, there was obtained a target plate bearing metallic thallium (612 mg) electro-plated thereon.

COMPARATIVE EXAMPLE 1

Thallium(I) sulfate (reagent grade) (4.3 g) was dissolved in distilled water (75 ml) with heating and stirring. After cooling to room temperature, conc. sulfuric acid (reagent grade) (1.1 ml) was added thereto to make an electro-plating solution.

The electro-plating was carried out as in Example 1 but using the electro-plating solution prepared above and adopting the following conditions: DC value, 57 mA; DC voltage, 2.8 V; time, 100 minutes. As the result, there was obtained a target plate bearing metallic thallium (656 mg) electro-plated thereon.

REFERENCE EXAMPLE

The thallium-carrying target plate as prepared in Example 1, 2, 3 or 4 was set in a cyclotron, and protons accelerated up to 26 MeV were irradiated thereon with an irradiation beam current of 120 $\mu$A for 3 hours, during which the target plate was cooled with water by a conventional procedure. Thirty minutes after completion of the irradiation, the target plate was taken out from the cyclotron and subjected to separation of $^{201}Tl$ by a conventional procedure. The yield of $^{201}Tl$ was proportionally greater on the basis of the irradiation beam current compared with the yield obtainable with the irradiation beam current of 30 $\mu$A or less on a conventionally prepared thallium-carrying target plate. During the irradiation, neither melting nor elimination of the target substance was observed.

On the other hand, the thallium-carrying target plate as prepared in Comparative Example 1 was set in a cyclotron, and protons accelerated up to 26 MeV were irradiated thereon with an irradiation beam current of 50 μA for 1 hour, during which the target plate was cooled by a conventional procedure. Thirty minutes after the completion of the irradiation, the target plate was taken out from the cyclotron and subjected to separation of $^{201}Tl$ by a conventional procedure. The yield of $^{201}Tl$ was very poor because of the waste of the target thallium during the irradiation.

What is claimed is:

1. A method for production of a thallium-carrying target material comprising a thermo-conductive support and metallic thallium electro-plated thereon, which comprises applying a DC-AC overlapped electric current between an anode made of a metal or its alloy having a lower ionization tendency than hydrogen and the electro-conductive support as a cathode, both electrodes being immersed in a bath of an electro-plating solution comprising monovalent thallium ions in the presence of at least one of aromatic amines and phenols, so as to deposit the thallium metal on the surface of the thermo-conductive support.

2. The method according to claim 1, wherein the thermo-conductive support is designed in a plate form suitable for the installation in a particle accelerator.

3. The method according to claim 1 or 2, wherein the thermo-conductive support is made of copper or its alloy.

4. The method according to claim 1, wherein the thallium electro-plated on the thermo-conductive support is thallium metal of natural isotopic composition or of enriched $^{203}Tl$.

5. The method according to claim 1, wherein the electro-plating solution is acidic.

6. The method according to claim 1, wherein the electro-plating solution contains 0.1 to 3 grams of the aromatic amine or phenol per 100 ml.

7. The method according to claim 1, wherein the DC-AC overlapping electric current is adjusted to a DC value of 5 to 150 mA, a DC voltage of 0.5 to 5 V and an AC voltage of 0.1 to 2 V.

8. A process for preparing $^{201}Tl$, which comprises irradiating accelerated particles upon the thallium-carrying target material prepared by the process according to claim 1 so as to convert the thallium metal into $^{201}Tl$.

9. The process according to claim 8, wherein the irradiation is effected with a cyclotron.

10. The process according to claim 9, wherein the irradiation is effected with an irradiation beam current of 80 to 150 μA.

* * * * *